US005448949A

United States Patent [19]

Bucher

[11] Patent Number: 5,448,949

[45] Date of Patent: Sep. 12, 1995

[54] METHOD AND DEVICE FOR ADJUSTING A CONTACT PRESSURE BETWEEN INK-CARRYING CYLINDERS OF A PRINTING MACHINE

[75] Inventor: Harald Bucher, Eschelbronn, Germany

[73] Assignee: Heidelberger Druckmaschinen AG, Heidelberg, Germany

[21] Appl. No.: 295,510

[22] Filed: Aug. 24, 1994

[30] Foreign Application Priority Data

Aug. 24, 1993 [DE] Germany ..... 43 28 444.2
Aug. 9, 1994 [DE] Germany ..... 44 27 967.1

[51] Int. Cl.[6] ..... B41F 31/30; B41F 33/00

[52] U.S. Cl. ..... 101/216; 101/352; 101/485

[58] Field of Search ..... 101/349, 350, 351, 352, 101/216, 228, 181, 183, 484, 485, 247; 73/78, 159, 150 R; 356/384, 385, 386, 429, 431; 250/548, 559

[56] References Cited

U.S. PATENT DOCUMENTS 3,599,889 8/1971 Pfeiffer ..... 242/55
4,676,094 6/1987 Hoffman ..... 73/78
4,817,883 4/1989 Hoffman ..... 73/78

FOREIGN PATENT DOCUMENTS 130260 4/1902 Germany .
451211 5/1968 Switzerland .

OTHER PUBLICATIONS

Papier und Druck 35 (1986) 3, (Grüner et al.) "Uber den Einsatz eines mikroprozessorgesteuerten Meβsystems im β Druckplattenwerk Berlin".

*Primary Examiner*—J. Reed Fisher
*Attorney, Agent, or Firm*—Herbert L. Lerner; Laurence A. Greenberg

[57] ABSTRACT

A contact pressure between ink-carrying cylinders of a printing machine are automatically adjusted. At least one ink-carrying cylinder can be disengaged from the ink-receiving cylinder. A width measuring device measures a width of a contact strip transferred from the ink-carrying cylinder to the ink-receiving cylinder. The measuring device may be aimed at the ink-receiving cylinder or at a product issuing from the last printing unit. A control or regulating device compares the signals which represent the width of the contact strip and, if necessary, adjusts the contact pressure. The adjustment may be parallel, i.e. the contact pressure is increased or decreased uniformly along the cylinder axis, or is may be one-sided, if the contact strip image is non-uniform or wedge-shaped.

6 Claims, 3 Drawing Sheets

(46)
(34.1)
(34.2)
37
1.2
(2.2)
46
32
34.2
34.1
31
45
3.2
4.2
5.2
6.2
8.2
9.2
19.2
7.2
39.2
40.2
44
38.2
1.1
(2.1)
43
42
40.1
3.1
4.1
5.1
6.1
8.1
9.1
19.1
7.1
30
39.1
41
33
38.1

METHOD AND DEVICE FOR ADJUSTING A CONTACT PRESSURE BETWEEN INK-CARRYING CYLINDERS OF A PRINTING MACHINE

BACKGROUND OF THE INVENTION

1. Field of the Invention

The invention relates to a method and devices for cylinder adjustment in which the contact pressure between cylinders is adjustable for the purpose of proper ink transfer between the respective cylinders.

2. Description of the Related Art

It has been heretofore known in the preparation and in the setting of printing machines to visually determine the force and the uniformity of the contact pressure across the entire width of the cylinder of an inking unit. A certain base amount of ink is introduced into the inking unit for that purpose, and distributed therein by way of rotation. When the cylinders are at a stillstand, a device is actuated which brings the ink-carrying cylinder into contact with an ink-receiving cylinder and then disengages the same. A contact strip is created on the ink-receiving cylinder whose width and whose shape provide an indication as to whether or not the pressure is sufficiently high and uniform. Depending on the result of the visual inspection of the contact strips, the contact pressure between the cylinders is increased or decreased with adjusting screws provided for the cylinder pressure adjustment. As seen along the width of the cylinders, the cylinder axes can be shifted in parallel relative to one another with the adjusting screws or they can be unevenly spaced from each another on their respective sides, such that the uniformity of the contact strip can be adjusted.

It has also been known to temporarily insert at least one paper strip between the cylinders. When the cylinders approach one another, a partial image is created on the paper strip from a partial area of the contact strip. The contact strip is then inspected visually. The inspection is not on the ink-receiving cylinder but by means of the reproduction. This method is advantageous when the visual accessibility in the inking unit does not allow for visual inspection or only to a limited degree.

It is disadvantageous in these prior methods that the visual inspection is error-prone and that the correct adjustment of the contact pressure between the cylinders depends on the experience of the operator.

Swiss patent CH 451 211 describes a device in which an especially formed testing body is provided for inspecting the adjustment of ink applicator rollers in a flat-bed high pressure machine. The testing body has defined dimensions and it serves as a gap gauge between the flat-bet form and the applicator roller. From the width of an ink strip, which the applicator rollers leave thereon, one can deduce the low position of the respective applicator roller. Besides the visual inspection and the expense in producing the testing body, this leads to the disadvantage that the inspection cannot be performed across the entire width of the applicator roller and that the testing body can hardly be utilized in rotary printing machines with barely accessible form rollers.

This is similarly the case with mechanically scanning devices, as for instance the one described in German patent 130 260. Feelers to be inserted underneath the roller are used there for adjusting the applicator rollers. The feelers cooperate through mechanical elements with an indicator for the position of the feeler. This leads to the additional disadvantage that, in order to prevent measurement errors, the feelers must be continually re-adapted to the variably resilient surface material on the rollers.

It has also been known heretofore in determining the contact pressure between two cylinders to dispose pressure sensors on the peripheral surface of one of the cylinders. The sensors provide signals which are proportional to the contact pressure and the signals can be used to adjust the contact pressure (DE 36 14 436 A1). Such a solution is logically very expensive because a multitude of pressure sensors must be provided over the entire peripheral surface and the signals must be transmitted from the rotating cylinders with special devices.

SUMMARY OF THE INVENTION

It is accordingly an object of the invention to provide a method and a device for adjusting a contact pressure between ink-carrying cylinders of a printing machine, which overcomes the hereinafore-mentioned disadvantages of the heretofore-known devices of this general type and which allows for a most accurate and uniform adjustment of the contact pressure at a low cost and independently of the press operator.

With the foregoing and other objects in view there is provided, in accordance with the invention, a system for adjusting a contact pressure between ink- carrying cylinders of a printing machine, comprising: means coupled to at least one ink-carrying cylinders of a printing machine for disengaging the at least one cylinder from an ink-receiving cylinder; width measuring means for measuring a width of a contact strip transferred from the ink-carrying cylinder to the ink-receiving cylinder of the printing machine, the width measuring means being aimed at the ink-receiving cylinder; a control or regulating device connected to the measuring means and receiving signals representative of the width of the contact strip from the width measuring means; and adjusting members connected to the control or regulating device and operatively connected to the at least one ink-carrying cylinder for adjusting a contact pressure between the ink-carrying cylinder and the ink-receiving cylinder.

In accordance with an added feature of the invention, the width measuring means include two sensors, the sensors being aimed at the ink-receiving cylinder and being disposed at edge regions thereof symmetrically relative to an axial center of the cylinder.

In accordance with an additional feature of the invention, the adjusting members include two electrical adjusting drives associated with the at least one ink-carrying cylinder and engaging at respective axial sides of the cylinder, and a position sensor associated with each of the adjusting drives.

In brief summary, the inventive concept is towards a device for measuring the width of the contact strip in a device for cylinder adjustment. The measuring device is aimed at the ink-receiving cylinder and it is connected via a control or regulating unit with adjusting members for adjusting the cylinder contact pressure.

The means for measuring the width of the contact strip may include two opto-electronic sensors, which are aimed at the peripheral surface of the ink-receiving cylinder. They are preferably disposed at edge regions of the cylinder and symmetrically relative to the axial center of the cylinder.

It is also possible to provide a photo-electronic array which measures across the entire width of the ink-receiving cylinder. The signals of the contact strip width are supplied to the control or regulating unit, which produces adjusting signals for the adjusting members, which adjust the cylinder pressure. The adjusting members may consist of two electrical adjusting drives, which engage on the two sides of the movable cylinder. A position sensor is associated with each adjusting drive.

In a simple embodiment, manually adjustable adjusting screws are provided as adjusting members, whereby an operator performs a deliberate adjustment of the contact pressure between the cylinders on the basis of the measured values provided by the control or regulating unit.

With the above and other objects in view there is also provided, in accordance with the invention, a system for adjusting a contact pressure of an ink-carrying cylinder of a printing machine, wherein the ink-carrying cylinder is coupled with a cylinder disengaging device, comprising: width measuring means for measuring a width of a contact strip transferred from the ink-carrying cylinder to a print material, the width measuring means being aimed at the print material on which the contact strip is imprinted; a control or regulating device connected to and receiving signals from the width measuring means; and adjusting members connected to the control or regulating device and operatively associated with the ink-carrying cylinder for adjusting a contact pressure thereof.

In accordance with a further feature of the invention, the width measuring means are aimed at the print material following a last printing unit of a multi-unit machine, as seen in a product flow direction.

The forgoing embodiment is particularly advantageous in that the width measuring device is aimed at the printing material. It is most preferred that the measurement takes place outside the printing unit, particularly following the last printing unit of the printing machine.

With the objects of the invention in view there is also provided, in accordance with the invention, a method of adjusting a contact pressure between ink-carrying cylinders of a printing machine, wherein at least one of the cylinders is engagable with and disengageable from a printing form cylinder. The method comprises the steps of:

inking an ink-carrying cylinder of a printing machine;

engaging and disengaging the cylinder from a printing form cylinder while the printing machine is held at a stillstand and forming a contact strip on the printing form;

producing at least one image of the contact strip formed on the printing form on a print material;

aiming a measurement device at the print material and issuing, with the measurement device, signals representing a width of the at least one image of the contact strip; and comparing the signals in a control or regulating device with reference signals, and issuing adjusting signals for actuating adjusting members in dependence on a result obtained in the comparing step for adjusting a contact pressure of the cylinders with the adjusting members.

Other features which are considered as characteristic for the invention are set forth in the appended claims.

Although the invention is illustrated and described herein as embodied in a method and a device for adjusting a contact pressure between ink-carrying cylinders of a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
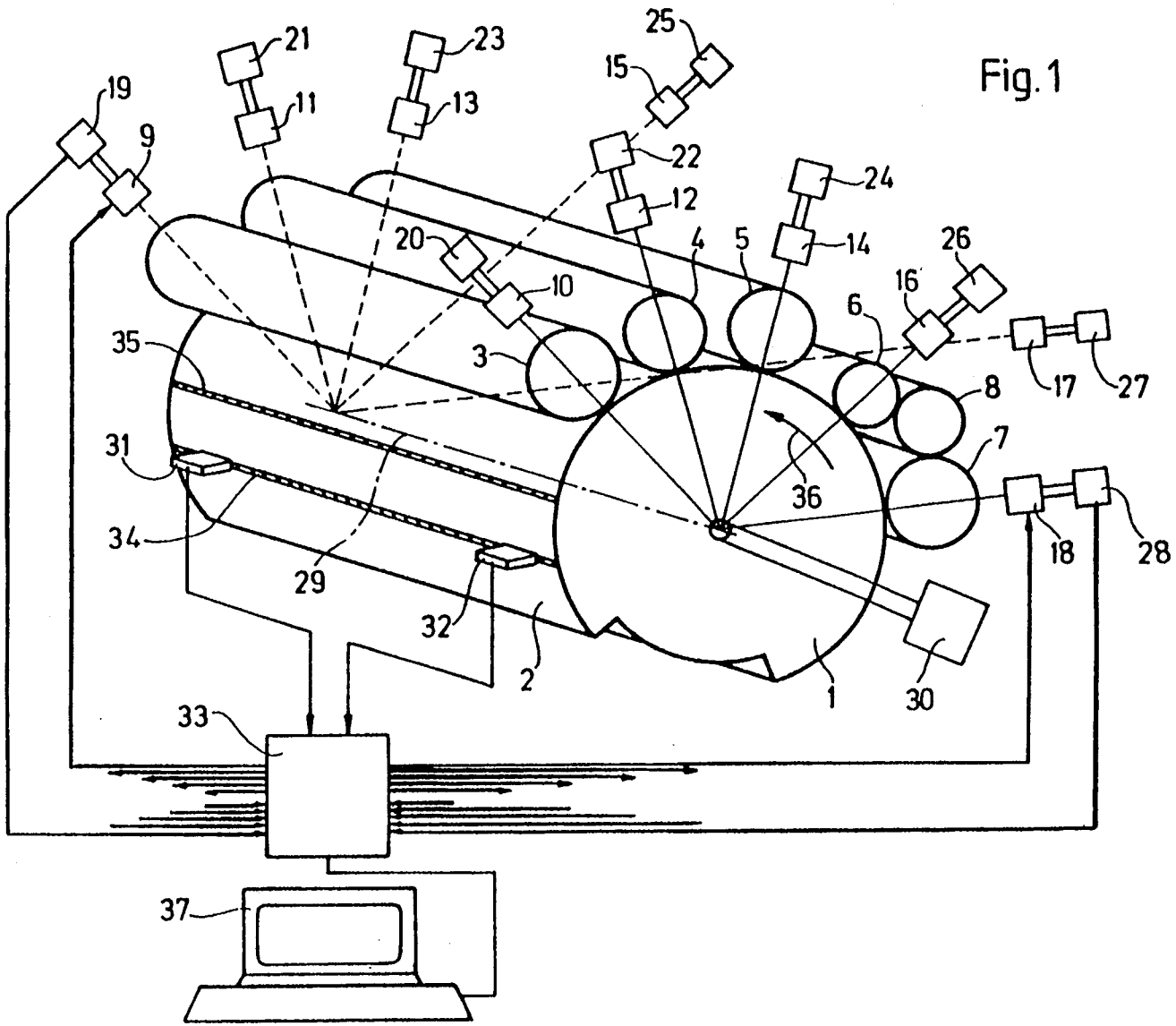
FIG. 1 is a perspective, schematic view of a first embodiment of the invention in which the measurement is taken inside the printing unit.

Referring now to the figures of the drawing in detail and first, particularly, to FIG. 1 thereof, there is seen a plate cylinder 1 on which a flexible printing form 2 is clamped. Form rollers 3, 4, 5, 6 and a dampening roller 7 are associated with the plate cylinder 1.

A connecting roller 8 is disposed between the form roller 6 and the dampening roller 7. The form rollers 3, 4, 5, 6 and the dampening roller 7 coupled with an adjusting drive 9, 10, 11, 12, 13, 14, 15, 16, 17, 18, respectively on both sides, which allows them to be engaged with and disengaged from the plate cylinder. The adjusting drives are in turn associated with respective position sensors 19, 20, 21, 22, 23, 24, 25, 26, 27, 28.

An angular position sensor 30 is coupled to a rotational axis 29 of the plate cylinder 1. Two stationary opto-electronic sensors 31, 32 are aimed at the surface of the printing form 2 at the outer periphery of the plate cylinder 1 along a peripheral line. The position sensors 19–28, the angular position sensor 30 and the sensors 31, 32 are connected to the inputs of a control or regulating device 33. The outputs of the control or regulating device 33 are connected with the adjusting drives 9–18.

The form rollers 3, 4, 5, 6 and the dampening roller 7 are first thrown off (disengaged) from the plate cylinder 1 by means of the control or regulating device 33.

Then the form rollers 3, 4, 5, 6 and the dampening roller 7 are inked via non-illustrated ink and dampening unit distributor configurations. The dampening roller 7 is inked via the connecting roller 8. In a following step, the form rollers 3, 4, 5, 6 and the dampening roller 7 are engaged with the plate cylinder, which is at a stillstand, and they are again disengaged, so that a contact strip 34, 35 results on the surface of the printing form 2 for each form roller 3, 4, 5, 6 and for the dampening roller 7. When the plate cylinder 1 is rotated in the direction of an arrow 36 the contact strips 34, 35 are successively sensed by the sensors 31, 32. The angular position sensor 30 provides the association of the measurement signals given by the sensors 31, 32 to the control or regulating device 33 with the form rollers 3, 4, 5, 6 and the dampening roller 7 which cause the imprint of the contact strips 34, 35. From the signals of the sensors 31, 32 and of the angular position sensor 30, the widths of the contact strips 34, 35 are determined in the control or regulating device 33; the widths may, if desired, be displayed on a screen 37.

The control or regulating device 33 produces adjusting signals for the adjusting drives 9–18 from the widths of the contact strips. The drives are thus caused to accurately adjust the contact pressure of a form roller 3, 4, 5, 6 or dampening roller 7. In the case of a parallel contact strip 34, 35, the adjusting drives 9–18 associated with a form roller 3–6 or the dampening roller 7 are adjusted in pairs and equally. If a contact strip 34, 35 is wedge-shaped, then the adjusting drives 9–18 of the respective form roller 3–6 or dampening roller 7 are unevenly adjusted. The adjustment and measurement procedures can run under program control.

Figure 2:
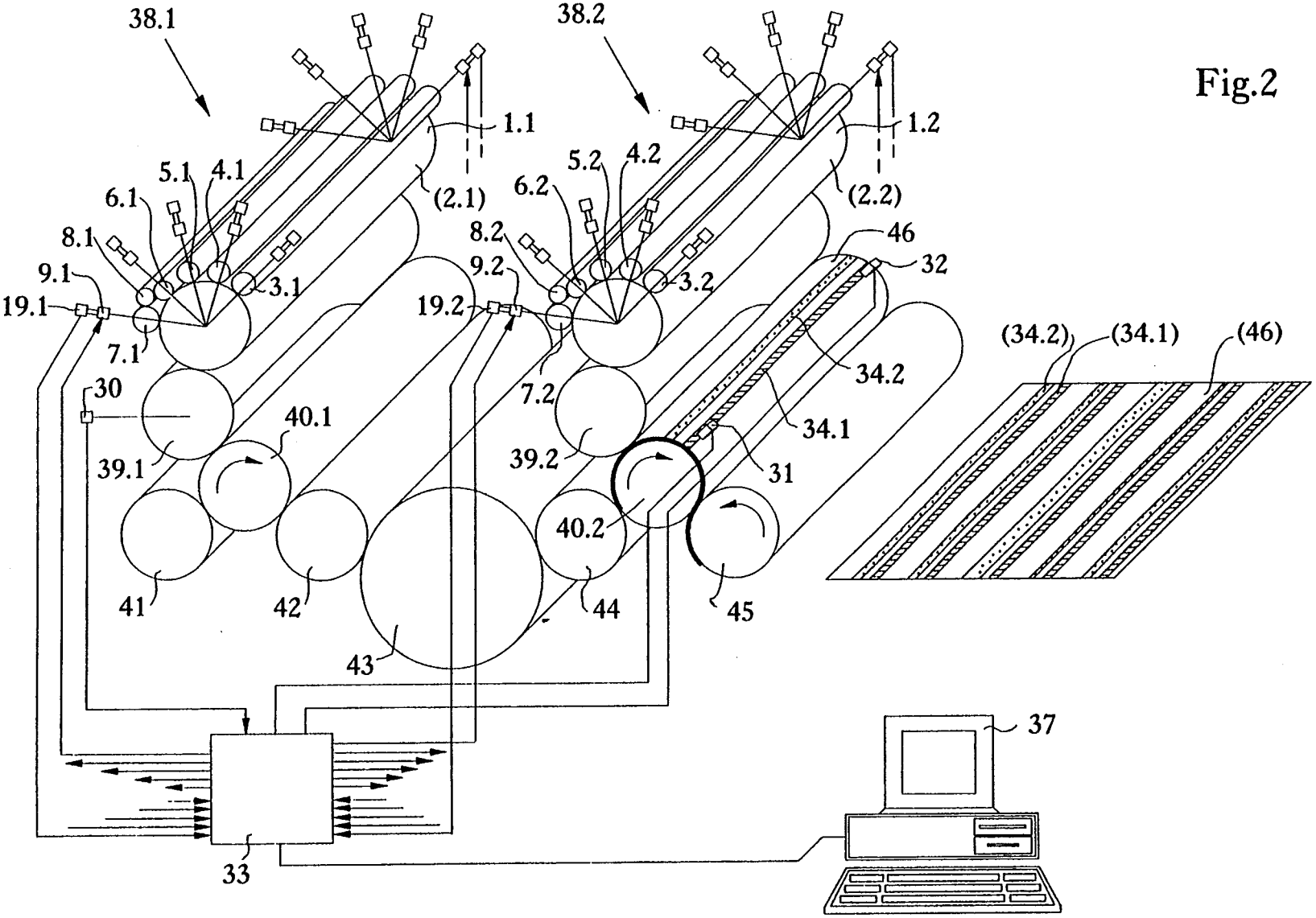
FIG. 2 is a similar view of a second embodiment in which the adjustment is based on a measurement taken on the printing material following the last printing unit.
Figure 3:
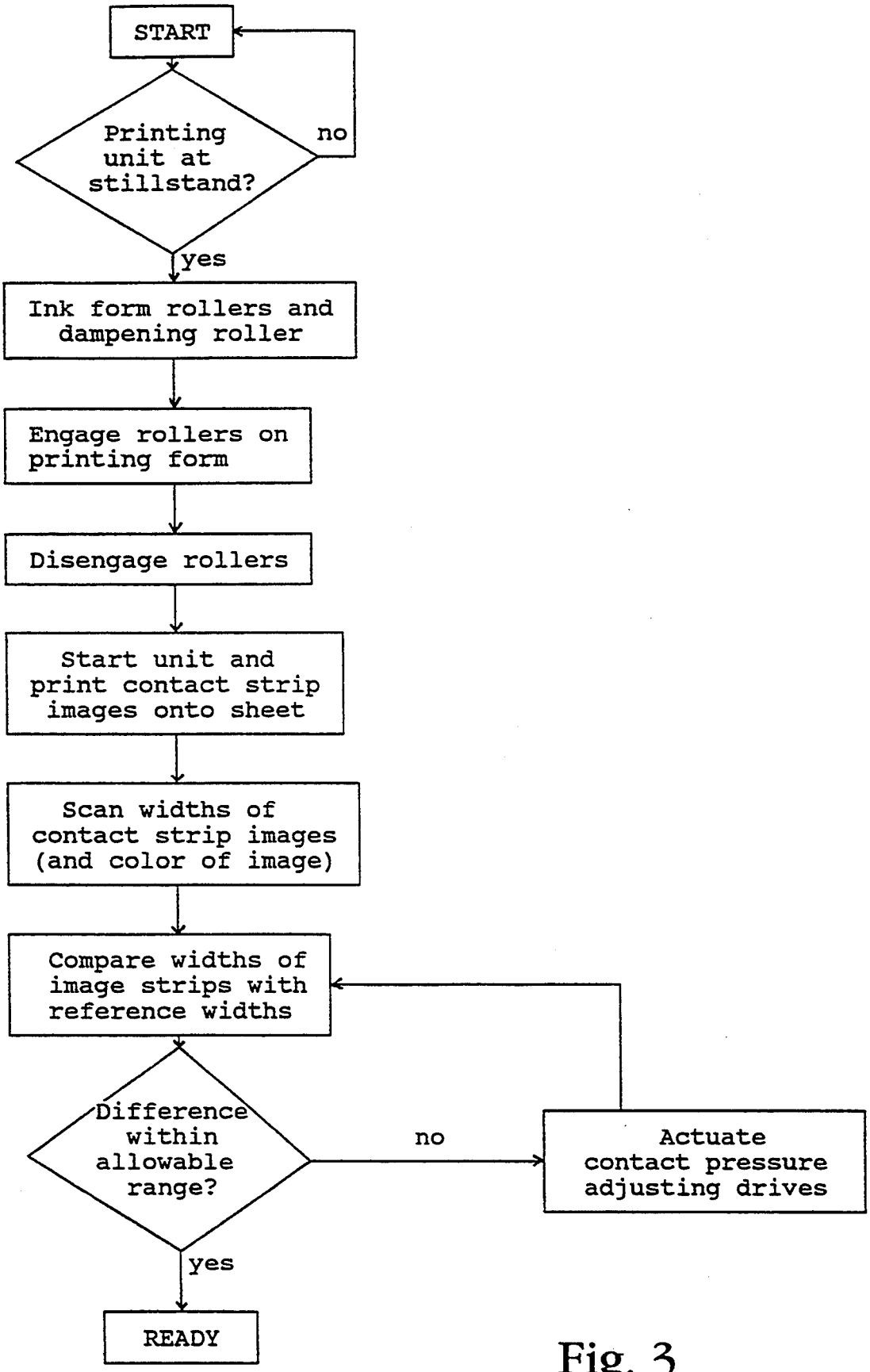
FIG. 3 is a flow chart of an exemplary method.

Referring now to the schematic illustration of FIG. 2, there are shown printing units 38.1, 38.2 of a two-color offset printing machine. Each printing unit includes a plate cylinder 1.1, 1.2; form rollers 3.1, 4.1, 5.1, 6.1, 3.2, 4.2, 5.2, 6.2; a dampening roller 7.1, 7.2; and a connecting roller 8.1, 8.2; a rubber cylinder 39.1, 39.2; an impression cylinder 40.1, 40.2; and transport cylinders 41 to 45. A sheet 46 with printed contact strips 34.1, 34.2 is present on the transport cylinder 40.2. The sensors 31, 32 in the printing unit are aimed at the sheet 46.

It is also possible to provide a single sensor 31 or 32 or a sensor array which opto-electronically senses across the entire width of the sheet 46.

The method according to the invention will now be described in detail with the aid of the device according to FIG. 2. The method includes the following steps:

In a first step, the form rollers 3.1, 3.2, 4.1, 4.2, 5.1, 5.2, 6.1, 6.2 are inked as uniformly as possible. In a further step—while the machine is at a stillstand, i.e. all of the cylinders are in resting position—the form rollers 3.1, 3.2 through 6.1, 6.2 are engaged on the printing form 2.1, 2.2 of the plate cylinders 1.1, 1.2 by means of the adjusting drives 9.1, 9.2 through 13.1, 13.2 and then again disengaged.

Then the printing machine is placed into operation and an imprint is produced on the sheet 46 of the contact strip 34, 35 formed on the printing form 2.1, 2.2.

As the sheet 46 leaves the printing unit 38.2, the images 34.1, 34.2 of the contact strips 34, 35 produced thereon are scanned by means of the sensors 31, 32. The signals of the sensors 31, 32 are fed to the control or regulating device 33, where the width of the image of the contact strips 34, 35 is determined from the signals. It can thereby be useful if the sensors 31, 32—besides the width of the images of the contact strips 34, 35—also evaluate the color of the printed contact strips 34.1, 34.2. This results in a simple association of the calculated widths with the respective form rollers (ink applicators) 3.1, 3.2 through 6.1, 6.2.

In a further step the signals for the width of the printed contact strips 34.2, 34.2 are compared in the control or regulating device 33 with reference signals, and adjusting signals are produced in dependence on the resulting comparative signal; the adjusting signals are supplied to the adjusting drives 9.1, 9.2 through 13.1, 13.2, so that all form rollers 3.1, 3.2 through 6.1, 6.2 can be uniformly adjusted to the desired contact pressure towards the respective plate cylinder 1.1, 1.2.

I claim:

1. System for adjusting a contact pressure between ink-carrying cylinders of a printing machine, comprising:

means coupled to at least one ink-carrying cylinders of a printing machine for disengaging the at least one cylinder from an ink-receiving cylinder;

width measuring means for measuring a width of a contact strip transferred from the ink-carrying cylinder to the ink-receiving cylinder of the printing machine, said width measuring means being aimed at the ink-receiving cylinder;

a control or regulating device connected to said measuring means and receiving signals representative of the width of the contact strip from said width measuring means; and adjusting members connected to said control or regulating device and operatively connected to the at least one ink-carrying cylinder for adjusting a contact pressure between the ink-carrying cylinder and the ink-receiving cylinder.

2. The system according to claim 1, wherein said width measuring means include two sensors, said sensors being aimed at the ink-receiving cylinder and being disposed at edge regions thereof symmetrically relative to an axial center of the cylinder.

3. The system according to claim 1, wherein said adjusting members include two electrical adjusting drives associated with said at least one ink-carrying cylinder and engaging at respective axial sides of the cylinder, and a position sensor associated with each of the adjusting drives.

4. A system for adjusting a contact pressure of an ink-carrying cylinder of a printing machine, wherein the ink-carrying cylinder is coupled with a cylinder disengaging device, comprising:

width measuring means for measuring a width of a contact strip transferred from the ink-carrying cylinder to a print material, said width measuring means being aimed at the print material on which the contact strip is imprinted;

a control or regulating device connected to and receiving signals from said width measuring means; and adjusting members connected to said control or regulating device and operatively associated with the ink-carrying cylinder for adjusting a contact pressure thereof.

5. The system according to claim 4, wherein the printing machine includes a plurality of printing units, and said width measuring means are aimed at the print material following a last printing unit as seen in a product flow direction.

6. A method of adjusting a contact pressure between ink-carrying cylinders of a printing machine, wherein at least one of the cylinders is engagable with and disengageable from a printing form cylinder, which method comprises the steps of:

inking an ink-carrying cylinder of a printing machine;

engaging and disengaging the cylinder from a printing form cylinder while the printing machine is held at a stillstand and forming a contact strip on the printing form;

producing at least one image of the contact strip formed on the printing form on a print material;

aiming a measurement device at the print material and issuing, with the measurement device, signals representing a width of the at least one image of the contact strip; and comparing the signals in a control or regulating device with reference signals, and issuing adjusting signals for actuating adjusting members in dependence on a result obtained in the comparing step for adjusting a contact pressure of the cylinders with the adjusting members.

* * * * *